US008431199B2

(12) United States Patent
Ruppert et al.

(10) Patent No.: US 8,431,199 B2
(45) Date of Patent: Apr. 30, 2013

(54) CONTAINER CONTAINING THE PMMA POWDER FRACTION OF A TWO-COMPONENT SYSTEM MADE UP OF PMMA POWDER COMPONENT AND MMA MONOMER COMPONENT

(75) Inventors: Klaus Ruppert, Maintal (DE); Mario Beyer, Bad Homburg (DE); Kevin Kerscher, Anspach (DE); Lutz Vocke, Bad Homburg (DE)

(73) Assignee: Heraeus Kulzer GmbH, Hanau (DE)

( * ) Notice: Subject to any disclaimer, the term of this patent is extended or adjusted under 35 U.S.C. 154(b) by 214 days.

(21) Appl. No.: 12/813,758

(22) Filed: Jun. 11, 2010

(65) Prior Publication Data

US 2010/0323144 A1 Dec. 23, 2010

(30) Foreign Application Priority Data

Jun. 18, 2009 (DE) ..... 10 2009 029 786

(51) Int. Cl.
*B32B 1/02* (2006.01)
*B32B 27/30* (2006.01)

(52) U.S. Cl.
USPC ..... 428/35.2; 428/35.7

(58) Field of Classification Search ..... 428/35.7, 428/35.2
See application file for complete search history.

(56) References Cited

U.S. PATENT DOCUMENTS

| | | | |
|---|---|---|---|
| 2003/0008936 | A1 | 1/2003 | Wachter et al. |
| 2009/0036612 | A1 | 2/2009 | Rheinberger et al. |

FOREIGN PATENT DOCUMENTS

| | | | | |
|---|---|---|---|---|
| DE | 195 37 671 | A1 | | 4/1997 |
| DE | 101 26 968 | A1 | | 12/2002 |
| DE | 10 2006 010 075 | A1 | | 9/2007 |
| EP | 0 132 726 | B1 | | 10/1988 |
| EP | 0 642 985 | A1 | | 3/1995 |
| EP | 941 939 | A1 | | 9/1999 |
| JP | 3-163053 | A | | 7/1991 |
| JP | 3163058 | | * | 7/1991 |
| JP | 11-511041 | A | | 9/1999 |
| WO | W09639107 | A1 | | 12/1996 |

OTHER PUBLICATIONS

English translation of Japanese Office Action issued Jul. 9, 2012, mailed Jul. 11, 2012.

* cited by examiner

*Primary Examiner* — Erik Kashnikow
(74) *Attorney, Agent, or Firm* — Norris McLaughlin & Marcus PA

(57) ABSTRACT

Containers that are soluble in liquid methylmethacrylate and contain the PMMA powder fraction of a two-component system made up of PMMA powder component and liquid MMA monomer component are useful as components of packaging of powder/liquid two-component material, such as dental material, investment material for histology or metallography or in veterinary medicine.

10 Claims, No Drawings

CONTAINER CONTAINING THE PMMA POWDER FRACTION OF A TWO-COMPONENT SYSTEM MADE UP OF PMMA POWDER COMPONENT AND MMA MONOMER COMPONENT

The invention relates to a container containing the poly (methyl methacrylate) (PMMAI) powder fraction of a two-component system made up of a PMMA powder component and a methyl methacrylate (MMA) monomer component, as well as uses of said container. The two-component system is, for example, a dental material.

BACKGROUND OF THE INVENTION

The manufacture of removable dentures such as complete or partial dentures involves the use of a so-called denture base material. By mixing a powder that is predominantly based on PMMA and a liquid that mainly consists of MMA, a usually gingiva-colored polymer is produced after curing that holds the artificial teeth in place in the full or partial dental prosthesis. Despite exact specification of the mixing ratio of powder and liquid being provided by the manufacturers in the instructions for use, the majority of users dose "by touch" based on the viscosity of the resulting mixture. This leads to variations in the material properties, the color impression, and the shrinking behavior. Moreover, the non-stoichiometric ratio of quantities that is used results in an elevated residual monomer content and associated increased health hazard to the patients. Furthermore, the above-mentioned variable shrinkage leads to inaccuracies of fit in the dental pieces.

Soluble containers for the storage of powder or compacted solids are generally known. EP 0 642 985 B1 discloses a packaging system for hazardous compositions with an external and an internal bag, each of which is water-soluble or water-dispersible. Said bags serve for separate storage of two hazardous agricultural agents, whereby the external bag, in addition to the agent, contains one or more internal bags that contain the other agent. Certain dosing quantities apply in accordance with claim 17. All of the packaging is designed to dissolve in water.

Water-soluble packaging bags have also become established in the field of detergents and dishwashing liquids. EP 0 132 726 B1 describes an internal packaging that is water-soluble at a predetermined temperature, whereas the external packaging is porous and permeable to water and product. The external packaging usually contains powder, and a solid, paste-like or liquid component can be stored in the internal packaging. A further development of this system is presented in DE 195 37 671 A1. Therein, the internal container is designed to be made of rigid or elastic water-soluble material, e.g. in the form of a capsule, rather than from flexible film.

EP 941 939 A1 describes a soluble product in a soluble container, both of which being designed for dissolution in a predetermined quantity of solvent. In accordance with claim 11, two containers, one situated inside the other, containing different soluble products are also possible.

It is the object of the invention to specify containers which are not subject to the above-mentioned disadvantages and facilitate simple, yet exact, dosing of the PMMA powder without requiring elaborate and expensive additional devices.

SUMMARY OF THE INVENTION

According to the present invention, for the powder component, a packaging material that is directly soluble in the liquid monomer component is recommended.

The invention therefore relates to containers containing the PMMA powder fraction of a two-component system for the manufacture of prosthesis materials made up of PMMA powder component and MMA monomer component that consist of a material, that is soluble in the MMA monomer solution.

Said object is met by a container containing the PMMA powder fraction of a two-component system made up of PMMA powder component and liquid MMA monomer component, the container consisting of a material that is soluble in the MMA monomer component. In a preferred embodiment of the invention the two component system is a dental material. In further embodiments the two component system is an investment material for histology or metallography or veterinary medicine. In a preferred embodiment of the Invention the container forms part of a combination packaging which also contains the MMA monomer component.

The soluble material is preferably PMMA film.

It is useful for the thickness of the walls of said film to be from 10 to 2000 μm, in particular from 20 to 200 μm.

DETAILED DESCRIPTION

It can be advantageous for the container, in its closed state, to touch closely against the PMMA powder. This is achieved, e.g., by evacuation. It is useful for the geometry of the container to be designed such that the fraction of film is as small as possible. The container can be micro-perforated, whereby the size of the perforations is smaller than the particle size of the powder packaged therein. The container can be designed in known fashion, e.g. as flat bag, flat bag with euro slot, flat bag with round hole, chain-type bag, flat-bottom bag, side-gusseted bag, stabilized bag, 3-side sealed bag, 4-side sealed bag, tetrahedral-shaped bag, block-bottom bag, capsule or compartment package.

According to the invention, the respective quantity of powder is packaged or sealed in a film that is soluble in the monomer (e.g. MMA). Polymer films that are made, e.g., of PMMA, lend themselves for this purpose.

In this context, the packaging can be implemented in the form of a bag with loose or compressed bulk powder or in the form of a compact filling surrounded in a form-fitting manner by a film.

The thickness of the film must be sufficient to withstand mechanical loads during production and transport undamaged and to provide sufficient protection to the product against ambient influences, moisture, and dirt, while being sufficiently thin to be dissolved partially or completely in as short a time as possible.

In this respect, thicknesses of <60 μm have proven useful.

The invention shall be explained in more detail by means of examples in the following Exemplary Embodiments 1. Bag production using a vertical tubular bag machine A PMMA film is used to produce 3-side sealed bags using a bagger machine with vertical operation. The machine is a form-fill-seal machine, in which the packaging means is formed, filled, evacuated, and sealed in a single process.

In a sequence of individual operations, the film is pulled off the roller, formed into tubular shape and sealed longitudinally during the vertical transport. Shortly before filling it with powder, a so-called transverse seal is formed and, after closing it, the bag is closed with a second transverse seal that is arranged upward of the product, and then separated.

Depending on the required output, said production can be of the single- or multiple-track type.

2. Production of a 3-side sealed bag using a horizontal tubular bag machine

The production of 3-side sealed bags follows a fixed basic scheme. The film (e.g. PMMA film) is reeled off the roller, the bottom is formed by folding, the sub-division into bag segments is effected by sealing. After separation into individual packages, the bag is filled and sealed in an automatic revolving transfer machine. Said machine can be linked in a chain to cartoning and final packaging in a linear packing line.

3. Production of a 4-side sealed bag using a horizontal tubular bag machine

The product is transferred inline between two horizontal bag webs that run parallel to each other. In the production flow, the bag is filled and then sealed all around as a 4-side sealed bag whose external contour is then cut.

4. Production of molded bags

The so-called upper and lower films (e.g. PMMA film) are reeled off the roller. In the process, the lower film is deep-drawn inline to form mold cavities via vacuum and thermoforming. Once film troughs have been formed by this process, the troughs are filled with powder and sealed with the upper film under a vacuum. Subsequently, the external edge of the molds is punched out and the bag is separated.

The invention claimed is:

1. A container consisting of a material that is soluble in liquid methyl methacrylate monomer (MMA) wherein the container contains a poly(methylmethacrylate) powder (PMMA) and wherein the PMMA and MMA form a two component system.

2. Container according to claim 1, formed of a PMMA film.

3. Container according to claim 2, wherein the wall thickness of the PMMA film is from 10 to 2000 μm.

4. Container according to claim 3, wherein the wall thickness of the PMMA film is from 20 to 100 μm.

5. Container according to claim 1, wherein, in a closed state, the container touches against the PMMA powder contained within.

6. Container according to claim 1, having a compact geometry with minimal fraction of film.

7. Container according to claim 1, being micro-perforated, whereby the size of the perforations is smaller than the particle size of the powder packaged therein.

8. Container according to claim 1, designed as a flat bag, flat bag with euro slot, flat bag with round hole, chain-type bag, flat-bottom bag, side-gusseted bag, stabilized bag, 3-side sealed bag, 4-side sealed bag, tetrahedral-shaped bag, block-bottom bag, capsule or compartment package.

9. Container according to claim 1, having a round, triangular, rectangular or polygonal, square, star-shaped, elongated, oval, elliptical or trapezoidal cross-section.

10. Container according to claim 1, wherein said two component system is a dental material.

* * * * *